US005704781A

United States Patent [19]

Swoboda

[11] Patent Number: 5,704,781

[45] Date of Patent: Jan. 6, 1998

[54] REFRACTORY WALL BRICK FOR A HEATING CHANNEL OF A RING PIT FURNACE

[75] Inventor: Reiner Swoboda, Eckental, Germany

[73] Assignee: Riedhammer GmbH and Co. KG, Nuremberg, Germany

[21] Appl. No.: 528,694

[22] Filed: Sep. 15, 1995

[30] Foreign Application Priority Data

Sep. 17, 1994 [DE] Germany ..... 44 33 154.1

[51] Int. Cl.[6] ..... F27B 7/28

[52] U.S. Cl. ..... 432/119; 432/192; 432/238; 52/606

[58] Field of Search ..... 52/592.6, 605, 52/606; 432/119, 168, 169, 177, 192, 238, 249, 248, 264, 265

[56] References Cited

U.S. PATENT DOCUMENTS 1,437,424 12/1922 Jones ..... 52/606
1,945,681 2/1934 Farrens ..... 52/606
2,727,382 12/1955 Kurz ..... 52/606
3,416,281 12/1968 Kopp ..... 52/606
3,471,136 10/1969 Hodl ..... 432/119

FOREIGN PATENT DOCUMENTS 409614 2/1945 Italy ..... 52/606

*Primary Examiner*—Noah P. Kamen
*Attorney, Agent, or Firm*—John F. A. Earley; John F. A. Earley, III

[57] ABSTRACT

The invention relates to a cuboidal, fireproof wall brick for a heating channel of an open round-chamber kiln, having two horizontally extending setting surfaces, two vertically extending setting surfaces and two front surfaces, characterized by at least one bead-like recess in the region of at least one setting surface, the recess extending from one front surface to the opposite front surface.

16 Claims, 2 Drawing Sheets

REFRACTORY WALL BRICK FOR A HEATING CHANNEL OF A RING PIT FURNACE

FIELD OF THE INVENTION

The invention relates to a cuboidal refractory brick for the wall of an open ring pit furnace. More particularly, the invention relates to a refractory brick having venting passages formed therein which extend obliquely from the front face surface to the back face surface.

BACKGROUND OF THE INVENTION

Ring pit furnaces, also known as sectional ring kilns or bay ring crucible kilns, in closed and opened form of construction, are known in the relevant art. Both closed and open kilns operate on the ring furnace principle whereby preheating, firing and cooling zones are formed inside the rotating fire.

A ring pit furnace of the closed type of construction is described, for example, in WO 92/22780 and EP 0 328 371 B1. Closed kilns are used in particular for firing carbon-containing shaped parts such as, for example, carbon or graphite electrodes. Closed kilns are also used as anode baking kilns.

A closed ring kiln typically comprises a plurality of chambers which are disposed successively and along side one another in such a way that, when viewed as a whole, they produce an approximately circular shape. Each chamber is subdivided into bays or cassettes by an arrangement of partition walls.

The individual chambers are interconnected in such a way that flue gases are conveyed from one chamber to the next. The interconnection is generally achieved by flue gas channels in the bay walls through which the flue gases flow either from the bottom up or from the top down. To create a sinusoidal or meander-like gas flow, the individual chambers are closed by lids which form a cavity at the top end of the bay walls through which flue gas may flow. This gas flow is similar to the cavity formed beneath the bay floors.

During the pyrolyric process, as early as in the preheating zone, vapors containing binding agent, so-called pyrolysis gases, are evolved which are collected below the lid and carried away with the flue gas.

Open ring pit furnaces have a different construction than the closed ring pit furnaces described above. Open ring pit furnaces have no chamber lids. To prevent the upward flow of pyrolysis gases, a filling powder (e.g., coking duff) is heaped on top of the material to be fired. The air permeability of the covering depends to a large extent upon the grain and settled density of the filling powder.

The open ring kiln includes heating channels (also known as heating flues or muffle flues) which run parallel in a longitudinal direction the kiln. The combustion chambers, i.e., bays containing the material to be fired and the filling powder, are located in between the parallel extending heating channels. Flue gases are drawn through the heating channels and heat the combustion chambers from two sides. The heating channels also include baffles which compel the flue gas to flow up and down in the heating channel in order to achieve uniformity of temperature.

In the prior art, the bricks of the walls of heating channels are constructed in a "porous" manner to allow the evolving pyrolysis gases to be conveyed from the combustion chambers into the heating channels, and withdrawn along with the flue gases. For example, it is known to construct the walls of the heating channel from cuboidal wall stones (bricks) which are held together by mortar in a manner similar to a typically clay brick wall. However, for the heating channel of an open ring kiln, a predetermined number, depending on the respective application, of mortar-free verticle joints are provided between adjacent wall bricks so that the evolving pyrolysis gases may be drawn through the mortar-free joints into the heating channel. The evolving pyrolysis gases are drawn through the mortar-free verticle joints due to a pressure differential (vacuum) between the heating channel and the combustion chambers.

There are several disadvantages to providing mortar-free verticle joints in the heating channel wall of an open ring kiln. Mortar-free verticle joints make the heating channel wall unstable, especially when the heating channels are repaired by replacing large wall sections of the heating channel wall. Further, as a result of thermal expansion and contraction, the mortar-free joints do not remain fixed in size or location over the course of time. If the mortar-free joint becomes larger, the pyrolysis gases burn to some extent inside the joints which may lead to local overheating and to deposit formation in the joint. Further, there is also the danger of larger joints becoming clogged with filling powder. The mortar-free joints are then unable to perform their function or an increased cleaning effort is required between firing cycles.

To partially alleviate this problem, it is known in the art to use wall bricks which are fixed in position relative to one another by tongue-and-groove joints to hold the joints constant. However, because of the high thermal loads in the kiln, it is practically impossible to achieve the desired dimensional stability in the joints.

SUMMARY OF THE INVENTION

Therefore, an object of the present invention is to provide a method of constructing the walls of a heating channel for an ring rotary kiln so that, even over a plurality of firing cycles, defined passages through the heating channel wall are maintained through which the pyrolysis gases may be drawn from the combustion chamber into the heating channel.

It is a further object of the present invention to provide a cuboidal refractory (fire proof) wall brick for constructing the walls of a heating channel for an open ring pit furnace wherein at least some of the bricks have defined passages extending therethrough from one face surface to the opposite face surface. The bricks comprising the heating channel wall are held together by mortar along both the vertical and horizontal setting surfaces. Since the wall bricks have passages extending therethrough, the finished (bricked) wall also includes passages therethrough even when both the vertical and horizontal setting surfaces of the individual bricks are held together by mortar. A heating channel wall constructed using the aforementioned wall bricks is more stable than prior art heating channel walls because a defined passage is provided in the edge region of the wall bricks and is maintained within a defined area of cross section irrespective of thermal influences during the firing cycles.

In a first embodiment, each wall brick has at least one bead-like passage in the region of at least one setting surface. The passage extends from one face surface to opposite face surface. In a second embodiment, the wall bricks have at least one channel-like passage extending through the interior of the brick from one face surface to the opposite face surface. In this embodiment, the pyrolysis gases flow through the brick via a central passage, not around the brick via a passage in the setting surface. Therefore, the brick may have mortar applied along the entirety of its four setting surfaces.

In both embodiments of the refractory wall brick described above, the cross sectional area of the passages can be varied depending on the respective field of application. The cross sectional area of the passages is selected in such a manner that the pyrolysis gases may reliably flow from the combustion chamber into the heating channel. At the same time, the cross sectional area of the passages is limited so that burning of the pyrolysis gases in the region of the passages is substantially precluded.

The cross sectional shape of the passages is also not subject to any limitation. Pot production engineering reasons, the cross sectional area of the bead-like passage in the first embodiment may be, for example, rectangular or semi-circular. In the second embodiment, the cross sectional shape of the passages is preferably circular.

As described in greater detail below, in the first embodiment of the invention, the passages are formed in the vertical setting surface of the refractory wall brick. If no mortar is applied between the vertical setting surfaces of adjacent wall bricks, i.e., in the manner described above with respect to the prior art wherein the bricks are laid immediately adjacent to one another to form mortar-free joints, the adjacent recesses form a recess having a cross sectional area twice that of the individual recess since the overall shape of adjacent wall shapes is identical.

The refractory wall brick of the present invention has the added advantage that the passages may be formed obliquely relative to the horizontal setting surfaces. Further, the refractory wall brick of the present invention can be used whether or not a mortar joint is formed at the vertical setting surfaces of adjacent bricks.

Preferably, the passages ascend upwardly from the front facing surface, i.e., the surface facing the combustion chamber, towards the back facing surface, i.e., the surface forming the heating channel wall. Since the passages ascend upwardly from the combustion chamber to the heating channel, the filling powder provided in the combustion chamber is prevented from entering and clogging the recesses. Further, any filling powder which may penetrate the passages automatically drops out after the firing process due to the inclination of the passages.

It is possible to combine the refractory wall bricks of the present invention with conventional wall bricks within a heating channel wall since it is not always necessary to form passages over the entire area of the wall for sufficient venting of pyrolysis gases from the combustion chamber to the heating channel.

Preferably, the horizontal and/or vertical setting surfaces of the wall bricks have a tongue-and-groove profile extending parallel to the wall surface to facilitate precise alignment of the wall bricks during assembly of the heating channel wall.

DESCRIPTION OF A PREFERRED EMBODIMENTS

Figure 1:
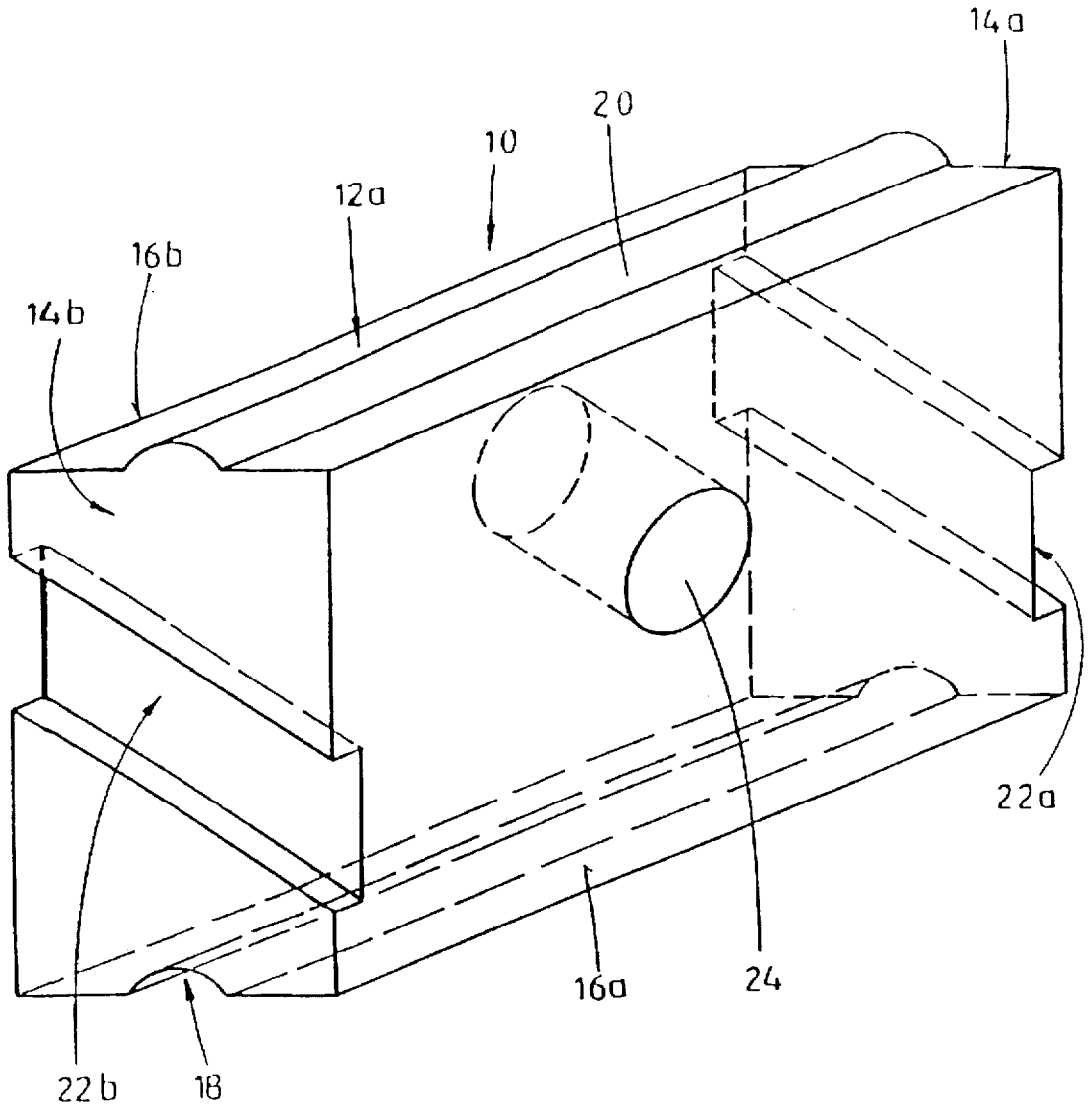
FIG. 1 is a perspective view of a refractory brick in accordance with an embodiment of the invention.

A first embodiment of the wall brick of the present invention, designated generally by reference numeral 10, has two horizontally extending setting surfaces **12*a*, 12*b*, two vertically extending setting surfaces 14*a*, 14*b*, and two face surfaces 16*a*, 16*b*. Referring to FIG. 1, one setting surface 12*b* forms the bottom setting surface, while one setting surface 14*b* forms the left setting surface. At a later stage, after construction of a complete heating channel wall, the face surface 16*a* is associated with the combustion chamber of an open ring pit kiln while the other face surface 16*b*** forms the interior wall of the heating channel of the kiln.

In a first embodiment, a groove-like recess 18 extends in a longitudinal direction in the bottom setting surface **12*b*. A tongue-like raised portion 20 is formed on the top setting surface 12*a*** which is designed to facilitate setting (alignment) of vertically adjacent wall bricks.

In the first embodiment, two bead-like recesses or passages **22*a*, 22*b* are formed in the vertical setting surfaces 14*a*, 14*b*. The recesses 22*a*, 22*b* extend between the front face surface 16*a* and the back face surface 16*b*. The recesses 22*a*, 22*b* are preferably identical in construction and are each rectangular in cross section. Referring to FIG. 1, the recesses 22*a*, 22*b* extend in an ascending course from the front face surface 16*a* towards the back face surface 16*b***.

To form a heating channel wall, the wall bricks 10 are mortared together in a conventional manner. Mortar is applied in the region of the top and bottom setting surfaces **12*a*, 12*b* as well as in the region of the vertical setting surfaces 14*a*, 14*b* except in the region of the recesses 22*a*, 22*b*. Once complete, through channels or passages 22*a*, 22*b* are formed between the front surface 16*a* and the back surface 16*b*** through which pyrolysis gases may be extracted from the combustion chamber into the heating channel and thereafter burnt or drawn away.

The inclined arrangement of the passages **22*a*, 22*b* has several advantages. First, filling powder, which is situated in the combustion chamber, may be reliably prevented from clogging the recesses 22*a*, 22*b*. For this reason, the angle of inclination alpha of the passages 22*a*, 22*b* is preferably greater than the corresponding angle of repose of the filling powder. Second, should filling powder nevertheless penetrate to some extent into the passages 22*a*, 22*b*, the powder automatically slides back out of the passages 22*a*, 22*b* as soon as the filling powder is removed from the combustion chamber because of the inclined orientation of the passages 22*a*, 22*b***.

In a second embodiment of the invention, a central opening or passage 24 through the brick is provided either in substitution for or in addition to the passages **22*a*, 22*b*. The function of the central opening 24 corresponds to that of the edgewise passages 22*a*, 22*b*. The opening 24 is also preferably arranged in an inclined manner and at the same angle of orientation as the passages 22*a*, 22*b***.

Figure 2:
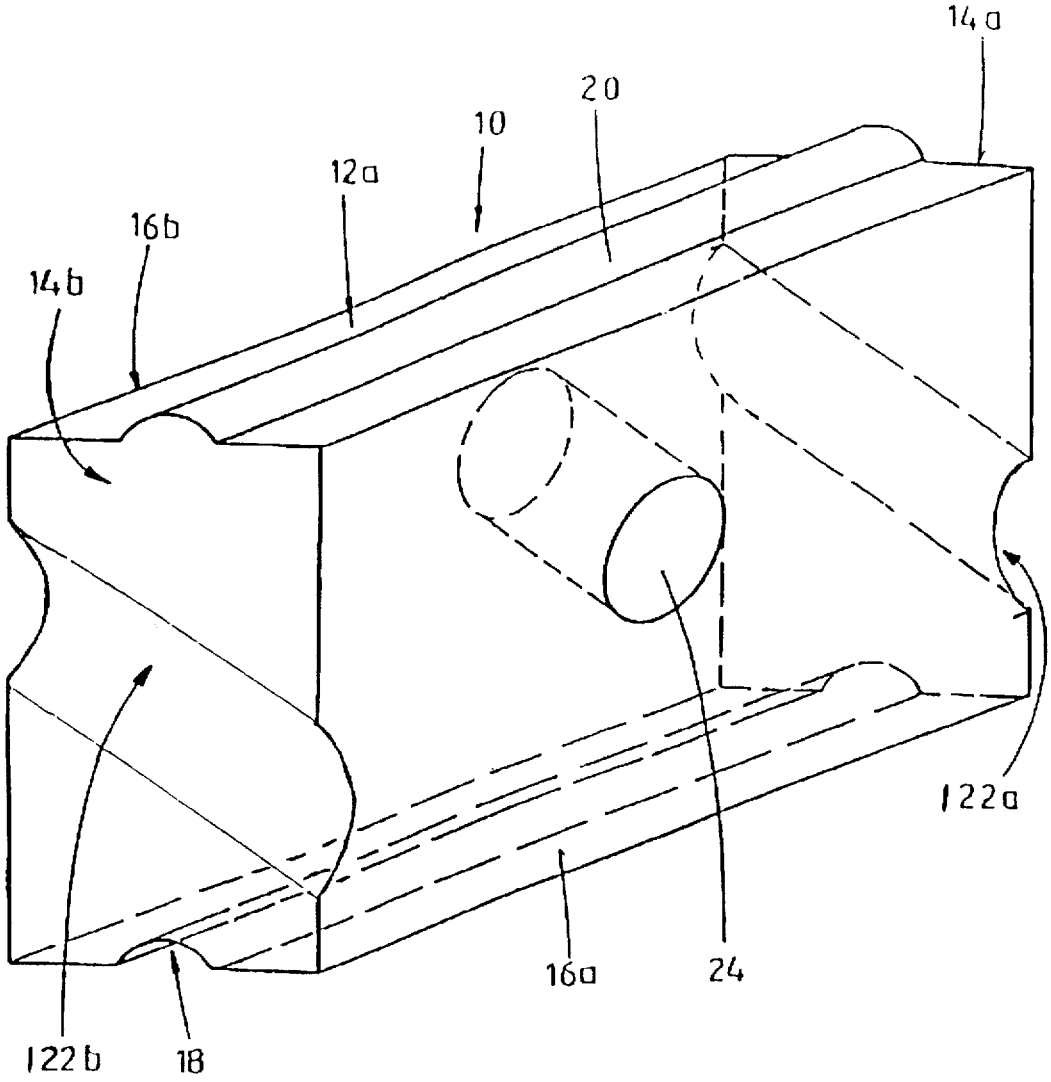
FIG. 2 is a perspective view of a refractory brick in accordance with a further embodiment of the invention.

A further embodiment of the invention is illustrated in FIG. 2 wherein the passages **122*a*, 122*b* have a semi-circular cross section as compared to the rectangular cross section of the passages 22*a*, 22*b*** shown in FIG. 1. Otherwise, the refractory wall brick of the embodiment shown in FIG. 2 is substantially similar to the embodiments described above with respect to FIG. 1.

I claim:

1. Cuboidal, refractory wall brick for a heating channel of an open ring pit furnace, having two horizontally extending setting surfaces, two vertically extending setting surfaces and two opposed face surfaces, characterized by at least one bead-like recess in the region of at least one setting surface, the recess extending obliquely relative to the horizontal setting surfaces from one face surface to the opposite face surface.

2. Wall brick according to claim 1, wherein at least one recess has a rectangular cross section.

3. Wall brick according to claim 2, wherein at least one recess is formed in the region of the vertical setting surfaces.

4. Wall brick according to claim 1, wherein at least one recess has a semi-circular cross section.

5. Wall brick according to claim 4, wherein at least one recess is formed in the region of the vertical setting surfaces.

6. Wall brick according to claim 1, wherein at least one recess is formed in the region of the vertical setting surfaces.

7. Wall brick according to claim 1, wherein at least one recess extends in an ascending manner relative to the bottom horizontal setting surface between one face surface facing the material to be fired and the opposed face surface facing the heating channel.

8. Wall brick according to one of claim 1, wherein one of the horizontally extending setting surfaces has a groove-like recess extending in a longitudinal direction of the wall brick and the other horizontally extending setting surface has a corresponding tongue-like raised portion extending in a longitudinal direction of the wall brick.

9. Wall brick according to claim 1, wherein at least one recess has a rectangular cross section, wherein recess is formed in the region of the vertical setting surfaces, wherein at least one recess extends in an ascending manner relative to the horizontal setting surface between one face surface facing the material to be fired and the opposed face surface facing the heating channel, and wherein one of the horizontally extending setting surfaces has a groove-like recess extending in a longitudinal direction of the wall brick and the other horizontally extending setting surface has a corresponding tongue-like raised portion extending in a longitudinal direction of the wall brick.

10. Cuboidal, refractory wall brick for a heating channel of an open ring pit furnace kiln, having two horizontally extending setting surfaces, two vertically extending setting surfaces and two opposed face surfaces, characterized by at least one channel-like opening which extends obliquely relative to the horizontal setting surfaces from one face surface to the opposite face surface.

11. Wall brick according to claim 2, wherein at least one opening has a circular cross section.

12. Wall brick according to claim 10, wherein at least one the opening has a rectangular cross section.

13. Wall brick according to claim 10, wherein at least one opening extends obliquely relative to the horizontal setting surfaces.

14. Wall brick according to claim 13, wherein at least one opening extends in an ascending manner relative to the bottom horizontal setting surface between one face surface facing the material to be fired and the opposed face surface facing the heating channel.

15. Wall brick according to claim 10, wherein one of the horizontally extending setting surfaces has a groove-like recess extending in a longitudinal direction of the wall brick and the other horizontally extending setting surface has a corresponding tongue-like raised portion extending in a longitudinal direction of the wall brick.

16. Wall brick according to claim 2, wherein at least one opening has a rectangular cross section, wherein at least one opening extends in an ascending manner relative to the bottom horizontal setting surface between one face surface facing the material to be fired and the opposed face surface facing the heating channel, and wherein one of the horizontally extending setting surfaces has a groove-like recess extending in a longitudinal direction of the wall brick and the other horizontally extending setting surface has a corresponding tongue-like raised portion extending in a longitudinal direction of the wall brick.

* * * * *